US005745955A

United States Patent [19]

Patelli et al.

[11] Patent Number: 5,745,955

[45] Date of Patent: May 5, 1998

[54] FLAT CARD WITH TOOTHED BELT DRIVE AND UPPER GUIDE FOR THE FLATS

[75] Inventors: Silvano Patelli; Antonio Cossandi; Giovanni Battista Pasini, all of Palazzolo Sull 'Oglio, Italy

[73] Assignee: F.LLI Marzoli & C. S.p.A., Bergamo, Italy

[21] Appl. No.: 810,367

[22] Filed: Mar. 3, 1997

[30] Foreign Application Priority Data

Mar. 4, 1996 [IT] Italy ..... MI96A0415

[51] Int. Cl.[6] ..... D01G 15/08

[52] U.S. Cl. ..... 19/102; 19/113

[58] Field of Search ..... 19/98, 99, 102, 19/103, 111, 113

[56] References Cited

U.S. PATENT DOCUMENTS

| | | | |
|---|---|---|---|
| 4,559,674 | 12/1985 | Rimmer et al. | 19/102 |
| 4,955,111 | 9/1990 | Jagst | 19/102 |
| 4,987,647 | 1/1991 | Von Gehlen | 19/111 |
| 5,473,795 | 12/1995 | Spix et al. | 19/113 |
| 5,542,154 | 8/1996 | Demuth et al. | 19/114 |

FOREIGN PATENT DOCUMENTS

| | | |
|---|---|---|
| 0366948 | 10/1989 | European Pat. Off. . |
| 0627507 | 5/1994 | European Pat. Off. . |
| 0683584 | 7/1995 | European Pat. Off. . |
| 090728 | 4/1995 | Japan . |
| 224941 | 3/1941 | Switzerland . |

*Primary Examiner*—Michael A. Neas
*Attorney, Agent, or Firm*—Diller, Ramik & Wight, PC

[57] ABSTRACT

A sliding flat formed from section bars for a card with moving flats driven by toothed drive belts, with upper return guides for the flats. The flats are provided in their ends with pins for cylindrical coupling with the toothed belts, said coupling pins projecting from the toothed belt such that it is they which rest on the return guides instead of the teeth of the toothed belt.

6 Claims, 6 Drawing Sheets

FLAT CARD WITH TOOTHED BELT DRIVE AND UPPER GUIDE FOR THE FLATS

BACKGROUND OF THE INVENTION

This invention relates to cards with sliding flats in which fibrous material in thin layer form is worked by a series of surfaces provided with a plurality of points of various shape, inclination and rigidity and driven to move relative to each other, in which the fibrous material is opened into single fibre form, the small trash particles being eliminated together with waste and tangles, and the fibres undergoing mutual mixing to form a sliver of untwisted fibres to be fed to the subsequent working stages.

To highlight the technical problems involved in carding and confronted by the present invention, the flat carding process is described briefly with reference to the prior art machine of FIG. 1. The raw material 1 consisting of staple fibres collected into the form of a web of approximately rectangular cross-section is fed to the machine by a feed roller 2 which presses and controls it against the board 3 to feed a strip 4 to the opening cylinder 5. This cylinder is provided with clothing, ie points inclined in its direction of rotation, and is driven at a considerable rotational speed. The fibre strip 4 is hence roughly combed and distributed over the opening cylinder into a layer thinner than the original layer 1. During its anticlockwise rotation the fibre layer encounters clothed segments and blades for removing impurities, after which the fibres pass to the subsequent carding drum 6. The drum 6 is driven at a rotational speed less than the cylinder 5, but as it has a much larger diameter its peripheral speed is higher. The points on the drum 6 are also inclined in the direction of movement, to remove the fibres from the surface of the cylinder 5 along the closest generating lines between 5 and 6. The moving flats 7 are located above the top of the drum 6. The moving flats are in the form of bars having a useful length corresponding to the generating line of the carding drum 6 and a few centimeters in width. That part thereof which faces the drum 6 is provided with clothing in the form of points pointing in the direction of movement. Generally the moving flats move slowly in a direction of rotation which is the same as or opposite to the that of the drum. The two clothings cooperate with typical carding action to provide fibre extension, cleaning, retention and depth control within the point clothing. It should however be noted that the peripheral drum speed is generally within the range of 15–40 meters per second, whereas the flat speed is of the order of a few millimeters per second.

The flats 7 circulate about the drum periphery conveyed by a drive member, for example a pair of chains 8 circulating about a series of drive and guide sprockets 9. Along the carding path between the drum and flats, the flats are guided by guides 10 which are preset with a precision of the order of a tenth and even down to a hundredth of a millimeter, to determine the distances between the drum clothing and the flat clothing, which are essential for the good outcome of the operation. The guides 10 are positioned at the edge of the flat faces of the drum, and on them there slide the end parts, without points, of the flats 7. The extended and cleaned fibres become arranged into a thin layer on the carding drum 6.

They are then detached by a discharge cylinder 11, also provided with points inclined in the direction of rotation, to enable the fibres carded by the drum 6 to be withdrawn and then discharged from the cylinder 11 by detachment cylinders not shown in the figure.

In the traditional art the bodies of the flats are generally constructed of ferrous material by casting, typically of cast iron, to which the point clothing for the carding is then applied. This type of construction satisfies the requirements of reliability, reproducibility, rigidity and life, but at the cost of an overall very heavy structure which results in considerable construction, installation and maintenance costs of the overall machine.

For these reasons the current tendency of the art is to pursue a lighter and more economical construction, for example by using card flat bodies produced from aluminium or light alloy sections, on which the card clothing is then fixed. These flats, formed from hollow sections of suitable moment of inertia, satisfy the need for good flexural and torsional rigidity, and are lighter and overall less costly even though a more valuable material is used. These light flats allow, inter alia, the general architecture of the machine to be modified, and enable toothed belt drives to be used instead of traditional metal chains.

European patent application EP-A-361 219 of Truetzschler GmbH describes a flat card system of this type. European patent application EP-A-567 747, again of Truetzschler GmbH, describes the insertion of stronger cylindrical pins into the external parts of the flats so that these pins would rest on the guides 10 instead of the ends of the light alloy section, which would wear more rapidly. These pins can be constructed of more wear-resistant materials and can be replaced during periodic machine maintenance at low cost.

European patent application EP-A-627 507 of Maschinenfabrik Rieter AG describes a flat card system of this type with coupling between the flat and the toothed drive belt by means of the actual pins which slide on the guides 10.

SUMMARY OF THE INVENTION

As can be seen from the accompanying figures, along the working lower path the belts are guided by the flats, which in their turn rest continuously on the guides 10. Along the inactive upper path the flats rest on the toothed belts, which are considerably stressed by the weight of the flats and may not be able to by themselves support all the flats without dangerous elongation. For this reason, a toothed belt drive requires the upper parts joining the sprockets 9A, 9C and 9B (FIG. 2) to be provided with support guides 40 on which the inverted flats 7 are supported along their non-working path.

A further technical problem relating to the use of guides 40 for the upper path of the flats derives from the fact that the relative position between the belts and flats is in this case inverted. The flats rest on the belts which—in the absence of suitable expedients—could slide on the guides 40, with considerable friction and wear.

An object of the invention is to provide an improved lightweight flat for said flat cards, and a system for guiding and driving it which uses a toothed belt drive but without the stated drawbacks of this type of drive when used in the aforesaid systems. A further object of the present invention is to provide a coupling system between the flat and belt which enables the flats to be properly guided along the path of the guides 10.

According to the present invention, coupling between the flat and the toothed belt is provided by a cylindrical form fit between the flats and the belt by means of recesses and projections, in which coupling pins projecting transversely from the ends of the flat engage in coherent cavities provided in the toothed belt, and in which said coupling pins 28 between the belt and flat are made to project from their cavity 26, 34 in the toothed belt 23, 33 respectively so that these rest on the return guides 40 in place of the projecting teeth 24 of the toothed belt.

BRIEF DESCRIPTION OF THE DRAWINGS

FIG. 2A, is a fragmentary side elevational view, and illustrates anti-friction bushings supporting a flat upon lateral guides.

FIGS. 2A and 2C, is a fragmentary side elevational view similar to FIG. 2C, and illustrates oppositely directed pins of a flat supported upon an upper surface of opposite lateral guides.

DESCRIPTION OF THE PREFERRED EMBODIMENTS

Figure 1:
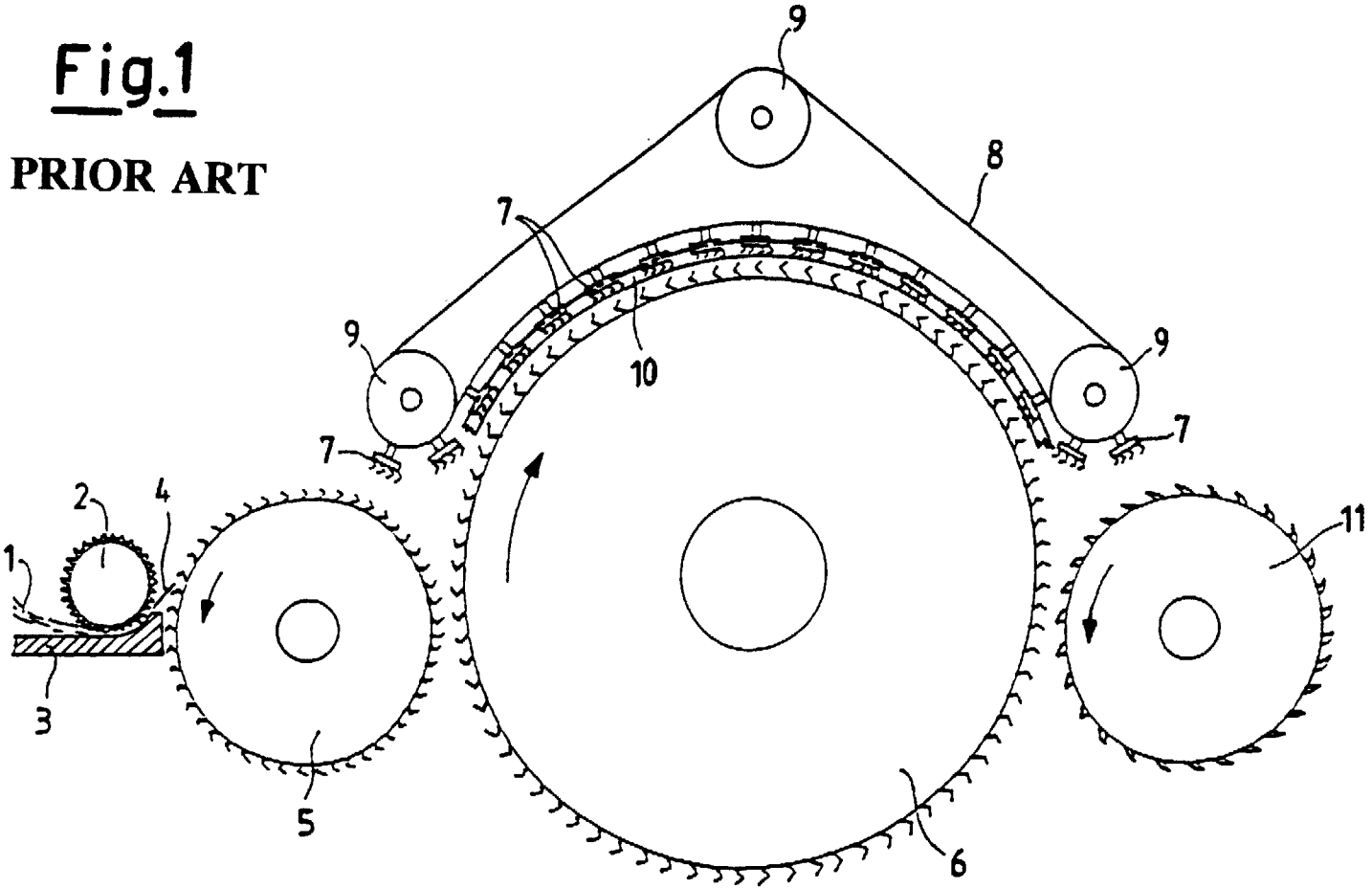
Fig.1 PRIOR ART
FIG. 1 is a schematic side elevational view of a prior art carding machine, and illustrates a carding drum along an upper periphery of which move carding flats connected to a pair of chains.
Figure 2A:
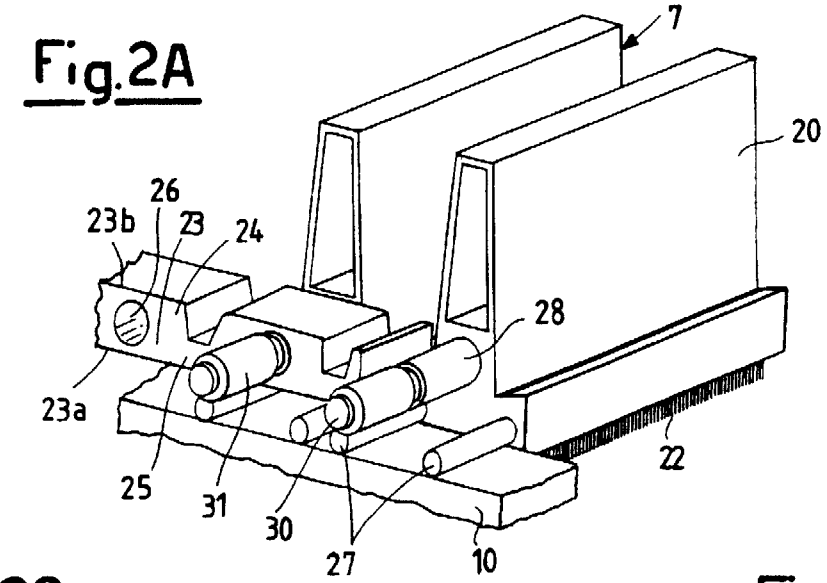
FIG. 2A is a perspective view of first embodiment of the invention, and illustrates one of a pair of belts for flats carrying pins projecting into cavities of the belts and at ends thereof carrying an anti-friction bearing.
Figure 2D:
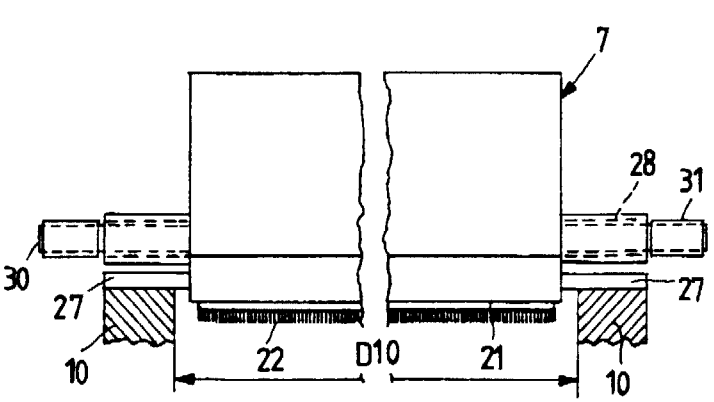
FIG. 2D, which appears on the sheet of drawings containing
Figure 2C:
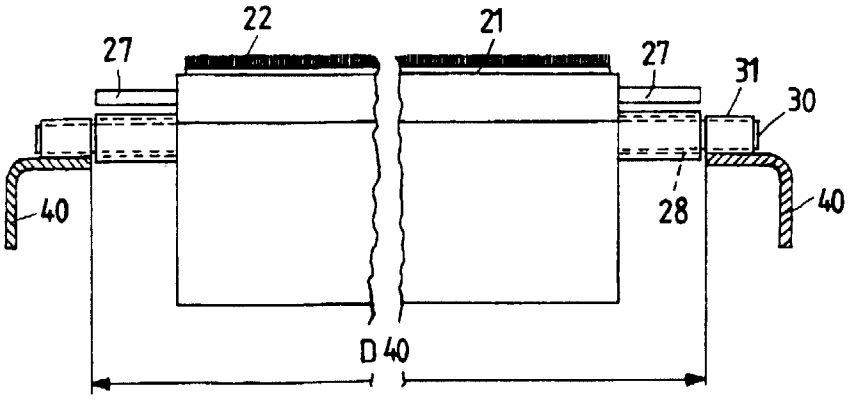
FIG. 2C, which appears on the sheet of drawings containing
Figure 2B:
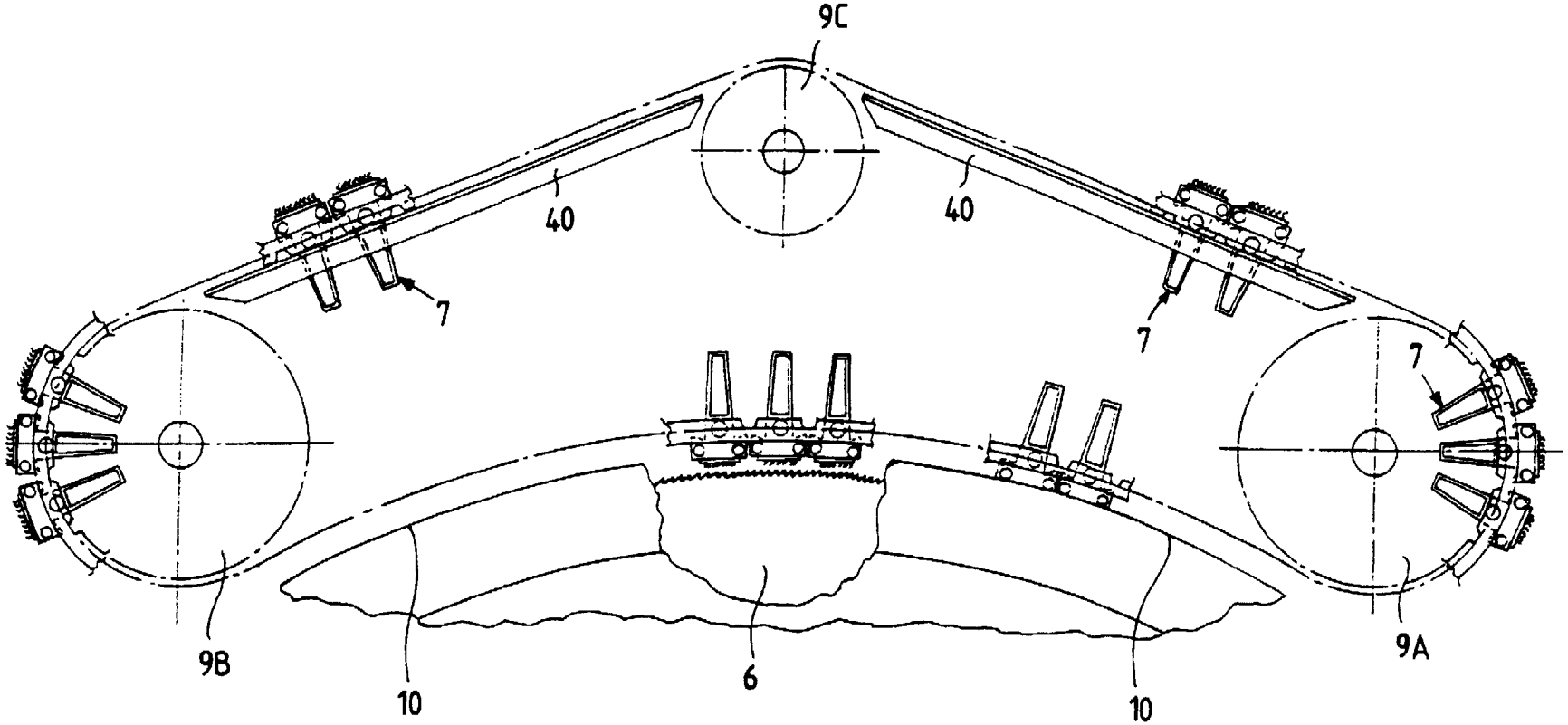
FIG. 2B is a fragmentary schematic side elevational view of an upper portion of a carding machine, and illustrates the manner in which guides support the flats during movement thereof by toothed belts or chains.

FIGS. 2A, B, C, D show a flat/toothed belt system of a first embodiment of the invention. FIG. 2A represents a perspective view of the flat/belt coupling, with the guide 10. FIG. 2B is a side view of the overall path of the flats. FIG. 2C is a transverse view of the flat/guide system along the upper guides 40, and FIG. 2D is a transverse view of the flat/guide system along the guides 10. The working flat 7 is preferably of inverted T cross-section to provide sufficient rigidity against flexural stress between the two guide supports 10, which are spaced apart transversely by a distance of the order of one meter. The shank 20 of the T is made hollow to achieve a high flexural moment of inertia. The body of the flat is obtained from a light alloy section of indefinite length, which is cut to size to a length less than the distance between the guides 10. Its lower face 21 is not involved with the guides 10 and carries the card clothing 22 indicated roughly as a series of points. The toothed belt 23 has a flat lower face **23*a* and a face 23*b*** worked in relief. Generally it is constructed of material of good flexibility, such as elastomeric materials possibly reinforced longitudinally with textile fibre threads and/or metal wires.

On the worked face **23*b* there is provided a series of projecting teeth 24 intended to engage the sprockets 9, and spaced apart by a series of lower portions 25. Within the thickness of the belt 23 there is provided a series of cylindrical cavities 26 of circular cross-section for housing the element by which it is coupled to the flats. In the embodiment of FIG. 2 the cavity is provided in the teeth 24**.

On the terminal faces at the two ends of the body of the flats 7, and in particular on the part forming the "cross-member of the T", there are fixed in a position closer to the face 21 two pins 27 of wear-resistant material, for example alloy steel, which are positioned horizontally and intended to slide on the card guides 10 to support the working flats facing the drum 6.

Again on the terminal faces of the body of the flats 7, but in a position relatively further from the lower face 21, there is fixed a horizontal pin 28 for insertion into the cylindrical cavity 26, transversely to the belt. The pin 28 is of cylindrical shape and has a size coherent with said cavity 26. The pins 28 are also preferably constructed of wear-resistant material.

The pins 27 and 28 can be fixed to the body of the flat in known manner, for example by a forced fit or by a screwed connection. To achieve one of the salient characteristics of the present invention, the coupling pin 28 between the belt and flat is constructed with a length projecting outwards from the end of the flat 7 which is substantially in excess of the width of its toothed belt 23 and consequently projects from it by a portion 30. According to a preferred embodiment of the invention, the projecting portion 30 can advantageously have applied to it a separate antifriction rolling bush 31, which reduces contact friction in its resting on the guide 40.

The upper pair of support guides 40 which have to support the weight of the flats 7 along their inoperative path are located a transverse distance apart $D_{40}$ which is greater than the transverse overall dimension of the pair of belts 23, which corresponds substantially to the distance $D_{10}$ between the guides 10 plus the thickness of the guides themselves, so that the profile of the teeth 24 of the pair of belts 23 remains within guides 40 and does not come into contact with them. The guides 40 are positioned a distance apart corresponding to that of the two portions 30 so that it is not the toothed belt which rests on the guides 40 but instead the portion 30, preferably provided with an antifriction bush 31. The flats, which are supported along the path of the guides 10 by the pins 27, are hence supported along the upper return path of the guides 40 by the pins 30, with reduced friction and wear.

Figure 3B:
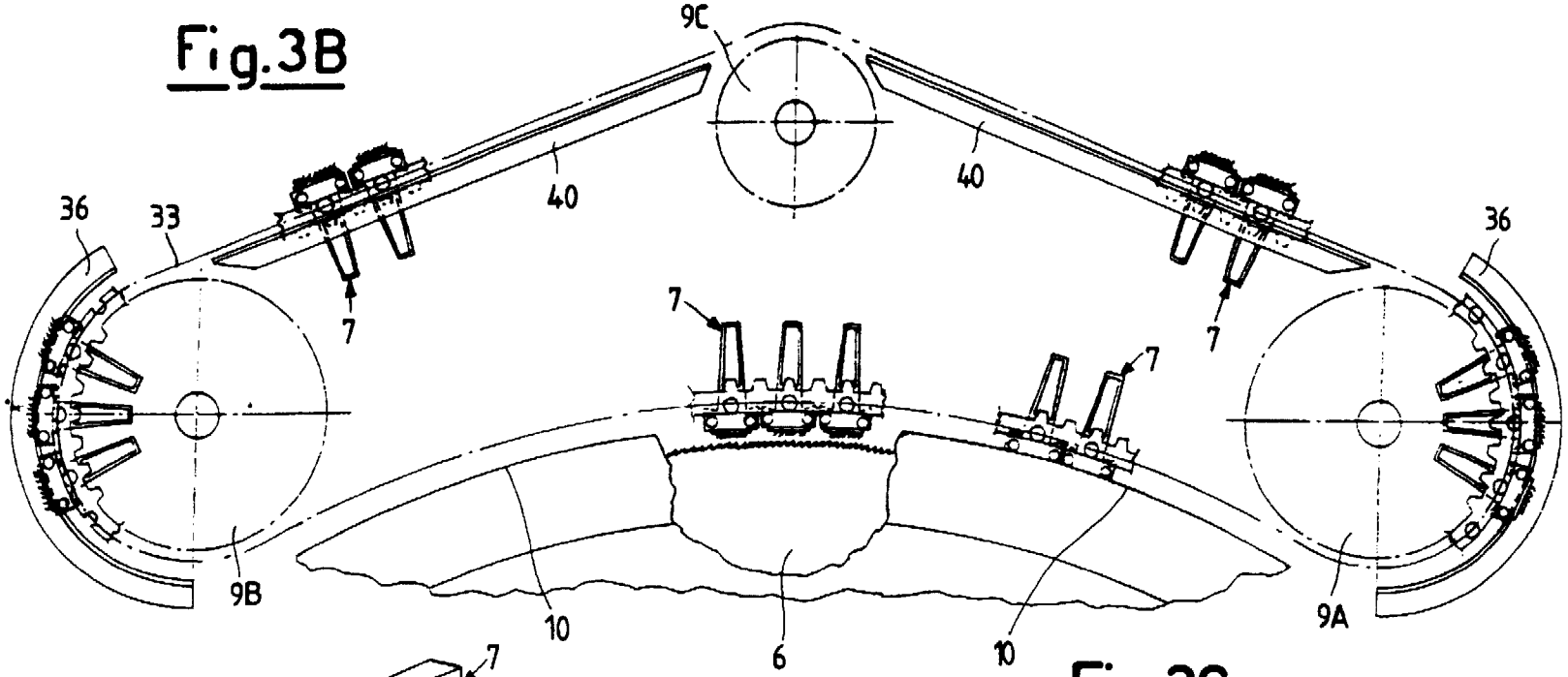
FIG. 3B is a fragmentary side elevational view of an upper portion of a carding machine similar to FIG. 2B, and illustrates another embodiment of card supports and guides.
Figure 3C:
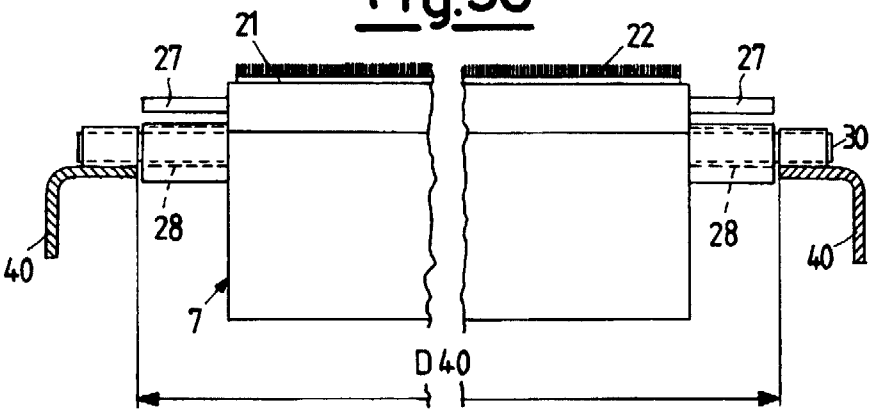
FIG. 3C is a fragmentary side elevational view, and illustrates the coupling elements or pins of FIG. 3A carrying anti-friction bushings supported upon lateral guides.
Figure 3A:
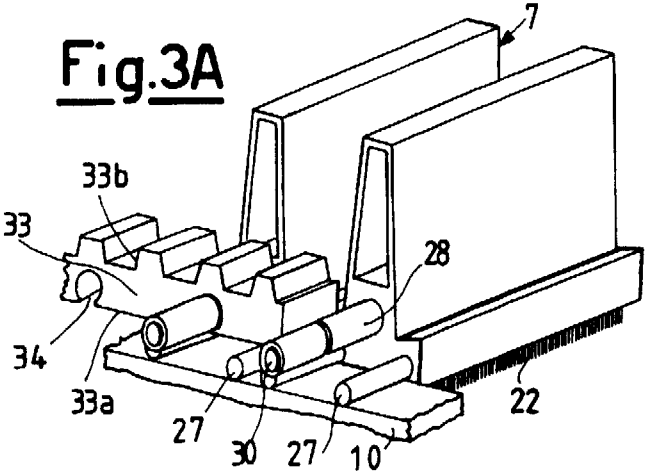
FIG. 3A is a perspective view of a portion of the carding machine of FIG. 3B, and illustrates downwardly opening cylindrical cavities for housing coupling elements of the flats.

The embodiment shown in FIGS. 3A, B, C uses a modification of the belt/flat coupling of FIG. 2.

The toothed belt 33 has its lower face **33*a* worked to engage the pins and its upper face 33B toothed to engage the sprockets 9** by means of its teeth.

In the lower face **33*a* there is provided a series of downwardly open cylindrical cavities 34 analogous to the cavities 26 of the preceding FIG. 2 and intended to house the corresponding coupling element 28 for the flats 7**.

Again in this embodiment the pins 28 have a projecting portion 30 which projects beyond the belt cavity 34 and is intended to rest on the guides 40.

It should be noted that in the aforedescribed embodiments the cavities 26, 34 are formed with an open cylindrical section, resulting in easier connection between the toothed belt and the flat, or with a closed cylindrical section, resulting in a connection with a greater guarantee of retention between the flat and the toothed belt, even if the belts are stresses to the extent of undergoing considerable deformation by elongation.

From the side view of the overall path of the flat/toothed belt system of the embodiment of FIG. 2 it can be seen that, along the path guided by the guide 10 for which on the other side of the drum there is another corresponding guide 10 parallel to it, the series of flats 7 is driven by the toothed belts 23 which follow the path defined by the sprockets 9, of which at least one is motorized and at least one is provided with belt tensioning members. As in the case of the guides 10, the sprockets are also provided in pairs, one for each side of the drum 6.

With the coupling system shown in the embodiment of FIGa. 2, when the flats separate from the guides 10, the toothed belts retain the flats during their engagement with the sprockets 9 until they have overturned with the clothing 22 on top. After this overturning the flat is supported on the belt 23.

In contrast, with the coupling system shown in the embodiment of FIG. 3, when the flats separate from the guides 10 the toothed belts 33 do not retain the flats during their engagement with the sprockets 9, and consequently supplementary guides 36, for example of L cross-section and extending as a semicircle, are required to compel the series of flats 7 passing about the sprockets 9A, B on the belt 33 not to separate from them until they have overturned with the clothing 22 on top. After passing about the sprocket and having passed from the guides 10 to the guides 40, the flat 7 rests on the belt 33.

This difference has however an advantageous side deriving from the fact that along their inoperative upper path from 9B to 9A the flats 7 always simply rest on the pair of belts 33.

In this respect it must be noted that in carding, the material is such as to require the cylinders and the flats to be subjected to frequent cleaning and to regeneration of the clothing.

In consideration of this and of the large number of flats installed on the machine, of the order of a hundred, it is advantageous to be able to remove and replace a flat by simply lifting it from its site on the pair of belts along its upper path. In devices of the known art, the flats are generally removed and replaced with greater complication. In the embodiment of FIG. 3 the flat is withdrawn without having to remove restrictions. If there are no particular safety regulations the flats can even be removed when in movement, given their low peripheral speed and their instant removability.

Figure 4A:
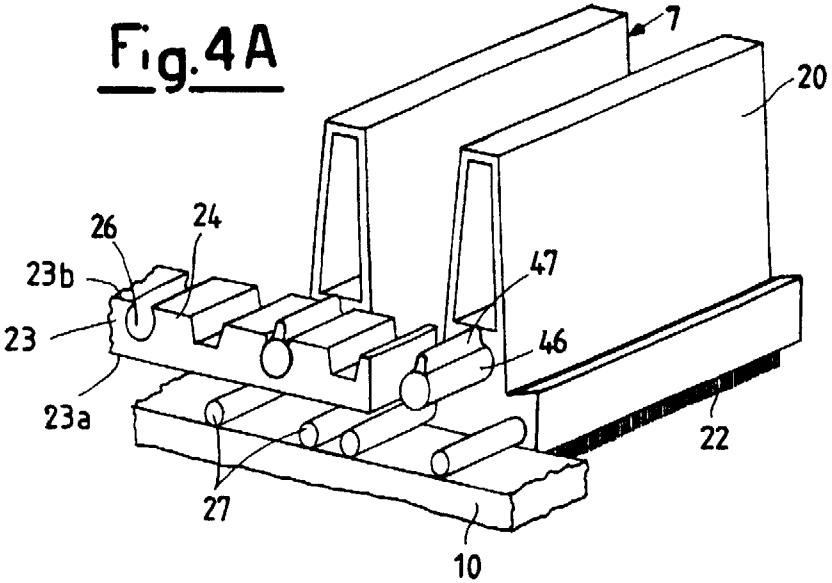
FIG. 4A is a perspective view of another embodiment of the invention, and illustrates flats having oppositely directed pins carrying small protuberances and lower pins resting upon opposite lateral guides.

The embodiment of FIGS. 4A, B, C uses a different coupling construction between the flat and belt, in which the cylindrical cavity 26 is open upwards.

In achieving one of the salient characteristics of the present invention, the coupling pin 46 between the belt and flat is constructed of "pear" cross-section with a small protuberance 47 protecting from the thickness of the tooth 24 of the toothed belt 23 into which the pin 46 is inserted.

Figure 4C:
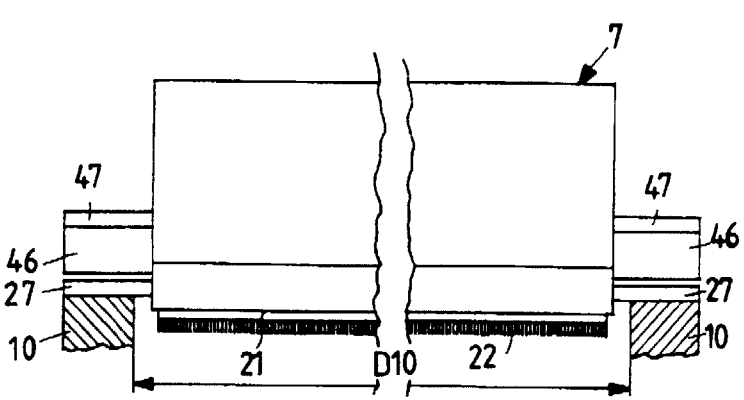
FIG. 4C is a fragmentary view of the mechanism of FIG. 4A, and similarly illustrates pins guided along lateral guides.
Figure 4B:
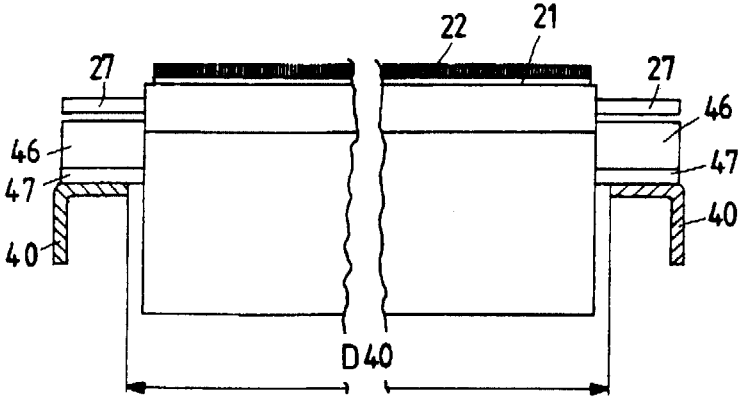
FIG. 4B is a fragmentary side elevational view of the mechanism of FIG. 4A, and illustrates the details of the support of the flats by the lateral guides.
Figure 5B:
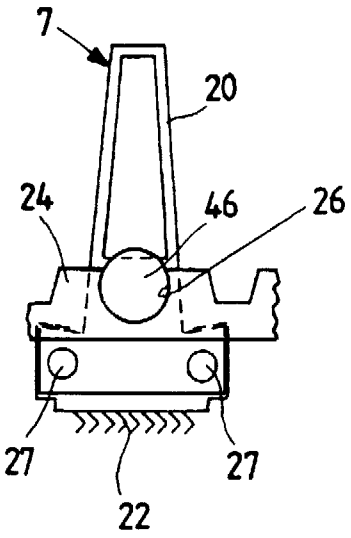
FIG. 5B is a fragmentary side elevational view of the mechanism of FIG. 5A, and illustrates further details thereof.
Figure 5A:
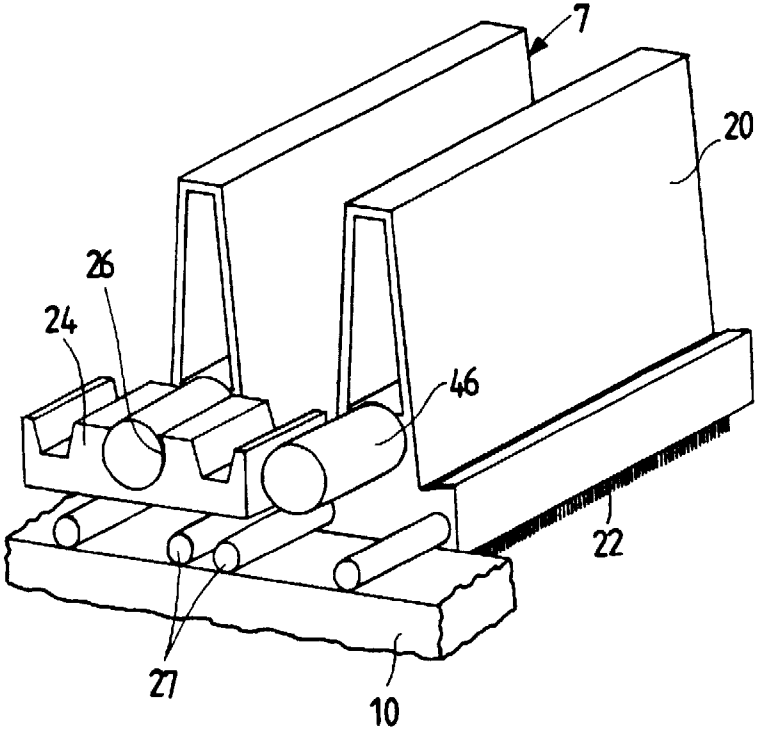
FIG. 5A is a perspective view of another embodiment of the invention, and illustrates relatively large connecting pins received in relatively large upwardly opening bores of a drive pulley or chain.

FIG. 4A is a perspective view of the flat/belt coupling, FIG. 4B shows the flat/guide configuration in the inoperative upper path of the flats along the guides 40, and FIG. 4C shows the flat/guide configuration in the working path along the guides 10. FIGS. 5A, 5B show a modification of the coupling of FIGS. 4 in which the cavity 26 into which the pin 46 is inserted has a depth less than the pin diameter so that, during the inoperative path of the flat, said pin 46 projects from the belts and raises them, in a manner similar to the embodiment of FIG. 4, so that it itself slides along the upper guides instead of the teeth of the belts, resulting in substantial reduction of friction.

The upper pair of support guides 40 which have to support the weight of the flats 7 along their inoperative path are located at a transverse distance apart $D_{40}$ substantially equal to the distance $D_{10}$ between the guides 10. The projection 46, 47 projects from the teeth 24 such that their contour along the pair of belts 23 remains separated from the guides 40 and does not make contact with them, it being the projection 46, 47 itself, preferably formed of material of good antifriction and antiwear characteristics, which slides along the guides. The flats, which are supported by the pins 27 along the path of the guides 10, are supported along the upper return path of the guides 40 by the pins 46, 47 with reduced friction and wear.

According to a preferred embodiment of the present invention the coupling system between the pins 28, 46 and cavities 26, 34 is constructed with circular cross-sections, to enable the flats 7 to undergo those adaptive angular movements about the coupling axis between the flats and toothed belt which enable the flats to follow the path of the guides 10 with absolute accuracy.

To allow this freedom of adaptive rotational movement, the pins 27 are mounted at a substantial distance from the bottom of the toothed belt 23*a*, 33*a*.

We claim:

1. A sliding flat (7) with its body produced from section bars, and a system for guiding and driving it in a card with moving flats driven by toothed drive belts, said flats being provided in their ends with cylindrical pins (27) for resting on guides (10) and provided on their lower face (21) with card clothing (22), said flat card being provided with a pair of guides (40) for the inoperative upper return path of the flats, characterised in that coupling between the flat (7) and toothed belt (23) is achieved by a cylindrical form fit with the toothed belts positioned at its ends, by means of cavities (26, 34) and coupling pins (28, 46) having their axis transverse to the toothed belt, said coupling pins (28, 46) between the belt and flat being made to project from their cavity (26, 34) in the toothed belt (23, 33), such that it is the coupling pins which rest on the return guides (40) instead of the projecting teeth (24) of the toothed belt.

2. A sliding flat with its body produced from section bars for carding devices, and a system for guiding and driving it in a card with moving flats driven by toothed drive belts as claimed in claim 1, characterised in that the coupling pin (28) between the belt and flat is constructed with a length projecting outwards from the end of the flat (7) which is greater than the width of its toothed belt (23, 33) and hence projects beyond it by a portion (30), the pair of support guides (40) being located a transverse distance apart ($D_{40}$) which is greater than the overall transverse dimension of the pair of belts (23), so that the profile of the teeth (24) of the pair of belts (23) remains within the guides (40).

3. A sliding flat with its body produced from section bars for carding devices, and a system for guiding and driving it in a card with moving flats driven by toothed drive belts as claimed in claim 2, characterised in that a separate antifriction rolling bush (31) is applied to the projecting portion (30) of the pin (28).

4. A sliding flat with its body produced from section bars for carding devices, and a system for guiding and driving it in a card with moving flats driven by toothed drive belts as claimed in claim 1, characterised in that the coupling pin (46) between the belt and flat is constructed with a "pear-shaped" cross-section with a small protuberance (47) projecting from the thickness of the tooth (24) of the toothed belt (23) into which the pin (46) is inserted, the upper pair of support guides (40) being located a transverse distance apart ($D_{40}$) which is substantially equal to that ($D_{10}$) between the guides (10).

5. A sliding flat with its body produced from section bars for carding devices, and a system for guiding and driving it in a card with moving flats driven by toothed drive belts as claimed in claim 1, characterised in that the cavity (26) into which the pin (46) is inserted has a smaller depth than the pin diameter so that, during the inoperative path of the flat, said pin (46) projects from the belts and raises them so that the pin itself slides on the upper guides instead of the teeth of the belts.

6. A sliding flat with its body produced from section bars for carding devices, and a system for guiding and driving it in a card with moving flats driven by toothed drive belts as claimed in one of the preceding claims, characterised in that the coupling between the pins (28, 46) and cavities (26, 34) is made with circular cross-sections, the pins (27) being mounted at a distance from the bottom of the toothed belt (23*a*, 33*a*).

* * * * *